US005426088A

United States Patent [19]

Janssens et al.

[11] Patent Number: 5,426,088

[45] Date of Patent: Jun. 20, 1995

[54] LIGHT-STABILIZERS FOR DYES FOR THERMAL DYE TRANSFER RECORDING

[75] Inventors: Wilhelmus Janssens, Aarschot; Luc Vanmaele, Lochristi, both of Belgium

[73] Assignee: Agfa-Gevaert N.V., Mortsel, Belgium

[21] Appl. No.: 237,022

[22] Filed: May 2, 1994

[30] Foreign Application Priority Data

May 12, 1993 [EP] European Pat. Off. ..... 93201367.5

[51] Int. Cl.[6] ..... B41M 5/035; B41M 5/38

[52] U.S. Cl. ..... 503/227; 428/195; 428/913; 428/914; 430/200; 430/201

[58] Field of Search ..... 8/471; 428/195, 913, 428/914; 503/227; 430/200, 201

[56] References Cited

U.S. PATENT DOCUMENTS

| | | | |
|---|---|---|---|
| 4,270,480 | 1/1988 | Ito et al. | 503/227 |
| 5,112,799 | 5/1992 | Egashira et al. | 503/227 |
| 5,217,942 | 6/1993 | Oshima et al. | 503/227 |
| 5,254,525 | 10/1993 | Nakajima et al. | 503/227 |

*Primary Examiner*—B. Hamilton Hess
*Attorney, Agent, or Firm*—Brumbaugh, Graves, Donohue & Raymond

[57] ABSTRACT

Dye-donor element for thermal dye recording comprising a dye layer comprising a dye and leuco-indoaniline dye as a light-stabilizer. The leuco-indoaniline dye is preferably a compound according to the formula:

wherein $R^1$ is H or any substituent, n is 0–4 each of $R^2$ and $R^3$ (same or different) is H or acyl, X is 0 or represents atoms completing a ring (system), each of $R^4$, $R^5$, $R^6$, and $R^7$ (same or different) is H, (cyclo)alkyl, aryl, alkyloxy, aryloxy, carbamoyl, sulphamoyl, —OH, halogen, —NH—$SO_2R^{12}$, —NH—$COR^{12}$, —O—$SO_2R^{12}$, or —O—$COR^{12}$, or $R^4$ and $R^7$ together and $R^5$ and $R^6$ together represent the atoms completing a ring (system), or $R^4$ and $R^8$ and/or $R^5$ and $R^9$ together and $R^5$ and $R^6$ together represent the atoms completing a heterocyclic nucleus, each of $R^8$ and $R^9$ (same or different) is H, (cyclo)alkyl, aryl, a heterocyclic nucleus, or $R^8$ and $R^9$ together represent the atoms completing a heterocyclic nucleus, each of $R^{10}$, $R^{11}$, and $R^{12}$ (same or different) represents (cyclo)alkyl group, alkenyl, aryl, alkyloxy, aryloxy, alkylthio, arylthio, amino, or a heterocyclic nucleus.

11 Claims, No Drawings

LIGHT-STABILIZERS FOR DYES FOR THERMAL DYE TRANSFER RECORDING

FIELD OF THE INVENTION

The present invention relates to ecologically acceptable light-stabilizers for use in thermal dye sublimation transfer and to a method of forming a light-fast dye image by thermal dye sublimation transfer.

BACKGROUND OF THE INVENTION

Thermal dye transfer methods include thermal dye sublimation transfer also called thermal dye diffusion transfer. This is a recording method in which a dye-donor element provided with a dye layer containing sublimating dyes having heat transferability is brought into contact with a receiver sheet and selectively, in accordance with a pattern information signal, heated with a thermal printing head provided with a plurality of juxtaposed heat-generating resistors, whereby dye is transferred from the selectively heated regions of the dye-donor element to the receiver sheet and forms a pattern thereon, the shape and density of which are in accordance with the pattern and intensity of heat applied to the dye-donor element.

A dye-donor element for use according to thermal dye sublimation transfer usually comprises a very thin support e.g. a polyester support, one side of which is covered with a dye layer comprising the printing dyes. Usually, an adhesive or subbing layer is provided between the support and the dye layer. Normally, the opposite side of the support is covered with a slipping layer that provides a lubricated surface against which the thermal printing head can pass without suffering abrasion. An adhesive layer may be provided between the support and the slipping layer.

The dye layer can be a monochromic dye layer or it may comprise sequential repeating areas of differently coloured dyes e.g. dyes having a cyan, magenta, yellow, and optionally black hue. When a dye-donor element containing three or more primary colour dyes is used, a multicolour image can be obtained by sequentially performing the dye transfer process steps for each colour.

A primary coloured dye layer e.g. a magenta or cyan or yellow dye layer may comprise only one primary coloured dye (a magenta, cyan, or yellow dye respectively) or may comprise a mixture of two or more primary coloured dyes of the same hue (two magenta, two cyan, or two yellow dyes respectively).

All imaging dyes are unstable to light to some extent. Dyes are indeed known to degrade through a number of pathways, which often involve dye triplet states, radicals and/or singlet oxygen. Any improvement in the light stability of dyes is highly desirable therefore.

In photographic silver halide systems various light-stabilizers for dyes are known. For instance UV-absorbers are used frequently in a top layer to shield dyes from the harmful influence of ultraviolet radiation.

Unfortunately, such technique cannot be used in thermal transfer systems, because the dyes, after having been thermally transferred to a receiver sheet, are located in the very top layer of said receiver sheet. If in that case UV-absorbers would be present as well in said top layer, they would intimately mix with the transferred dyes and thus give rise to a so-called catalytic fading effect, which would degrade the dyes even faster.

For use in thermal transfer other types of light-stabilizers such as singlet oxygen quenchers and metal chelates have been described e.g. in EP 312,812. Although these compounds are known to constitute a class of effective stabilizers to light, their performance is not equally adequate for all types of dyes. But above all, the use of such light-stabilizers is undesirable because most of them comprise heavy metal ions, which nowadays raises increasing resistance for ecological reasons.

Furthermore, certain known light-stabilizers cause an undesirable stain in the receiver sheet.

SUMMARY OF THE INVENTION

It is therefore an object of the present invention to provide ecologically acceptable light-stabilizers for dyes.

It is another object of the present invention to provide a dye-donor element for use according to thermal dye sublimation transfer comprising ecologically acceptable light-stabilizers for dyes.

It is another object of the present invention to provide a method of forming a light-fast dye image by thermal dye sublimation.

It is a further object of the present invention to provide a dyed receiver sheet comprising at least one dye and at least one ecologically acceptable light-stabilizer that does not cause undesirable stain in said receiver sheet.

It is a further object of the present invention to provide a receiver sheet comprising an ecologically acceptable light-stabilizer for dyes.

These and other objects are achieved according to the present invention by means of a dye-donor element for use according to thermal dye sublimation transfer, said dye-donor element comprising a support having thereon a dye layer comprising at least one dye and a binder, wherein said dye layer or a top layer thereon also comprises a light-stabilizer for said at least one dye, said light-stabilizer being a leuco-indoaniline dye preferably corresponding to the following general formula:

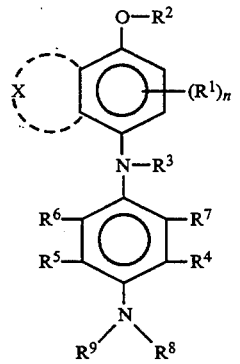

wherein:

$R^1$ represents hydrogen or any substituent, n is zero or a positive integer chosen from 1 to 4, and when n is 2, 3, or 4, $R^1$ has same or different significances, each of $R^2$ and $R^3$ (same or different) represents hydrogen,—$COCOR^{10}$, or an acyl group chosen from —$COR^{10}$, —$SO_2R^{10}$, and —$OPR^{10}R^{11}$, X is zero or represents the atoms needed to complete an aromatic, alicyclic, or heterocyclic ring or ring system, or a such ring or ring system in substituted form, each of $R^4$, $R^5$, $R^6$, and $R^7$ (same or different) represents hydrogen, an alkyl group, a substituted alkyl group, a cycloalkyl group, a substituted cycloalkyl group, an aryl group, a substituted aryl group, an alkyloxy group, a substituted alkyloxy group, an aryloxy group, a substituted aryloxy group, a carbamoyl group, a substituted carbamoyl group, a sulphamoyl group, a substituted sulphamoyl group, hydroxy, a halogen atom, —NH—$SO_2R^{12}$, —NH—$COR^{12}$, —O—$SO_2R^{12}$, or —O—$COR^{12}$, or $R^4$ and $R^7$ together and $R^5$ and $R^6$ together represent the atoms necessary to complete an aliphatic ring, a substituted aliphatic ring, a heterocyclic nucleus, a substituted heterocyclic nucleus, a heterocyclic nucleus carrying a fused-on cycloaliphatic, aromatic, or heterocyclic ring or ring system, or a substituted heterocyclic nucleus carrying a fused-on cycloaliphatic, aromatic, or heterocyclic ring or ring system, or $R^4$ and $R^8$ and/or $R^5$ and $R^9$ together and $R^5$ and $R^6$ together represent the atoms necessary to complete to complete a heterocyclic nucleus or a substituted heterocyclic nucleus, each of $R^8$ and $R^9$ (same or different) represents hydrogen, an alkyl group, a substituted alkyl group, a cycloalkyl group, a substituted cycloalkyl group, an aryl group, a substituted aryl group, a heterocyclic nucleus, a substituted heterocyclic nucleus, or $R^8$ and $R^9$ together represent the atoms necessary to complete to complete a heterocyclic nucleus or a substituted heterocyclic nucleus, each of $R^{10}$, $R^{11}$, and $R^{12}$ (same or different) represents an alkyl group, a substituted alkyl group, a cycloalkyl group, a substituted cycloalkyl group, an alkenyl group, a substituted alkenyl group, an aryl group, a substituted aryl group, an alkyloxy group, a substituted alkyloxy group, an aryloxy group, a substituted aryloxy group, an alkylthio group, a substituted alkylthio group, an arylthio, a substituted arylthio group, an amino group, a substituted amino group, a heterocyclic nucleus, or a substituted heterocyclic nucleus.

The present invention also provides a method of forming a light-fast dye image by image-wise heating a dye-donor element comprising a dye layer comprising a binder and at least one dye, and in said dye layer or in a layer on top of said dye layer a light-stabilizer for said dye, said light-stabilizer being a leuco-indoaniline dye preferably corresponding to the above general formula, and causing transfer of the image-wise heated dye and light-stabilizer to a receiver sheet.

According to an alternative embodiment of the method of forming a light-fast dye image according to the present invention, the method comprises forming a light-fast dye image by image-wise heating a dye-donor element comprising a dye layer comprising a binder and at least one dye, and causing transfer of the image-wise heated dye to a receiver sheet, wherein said receiver sheet comprises as a light-stabilizer for the transferred dye, a leuco-indoaniline dye preferably corresponding to the above general formula.

The present invention further provides a dyed receiver sheet comprising at least one dye and at least one light-stabilizer for said dye, wherein said dye and said light-stabilizer are present in an image-wise distribution produced by thermal dye sublimation transfer from a dye-donor element and said light-stabilizer dye is a leuco-indoaniline dye preferably according to .the above general formula.

The present invention also provides a receiver sheet for receiving an image-wise distribution of dye by thermal dye sublimation transfer from a dye-donor element, wherein said receiver sheet comprises as a light-stabilizer for said dye a leuco-indoaniline dye.

DETAILED DESCRIPTION OF THE INVENTION

A non-exhaustive list of preferred leuco-indoanilines for use as light-stabilizers is given in Table 1 hereinafter.

TABLE 1

| Dye formula N° | | Structural Melting at |
|---|---|---|
| S.01 | 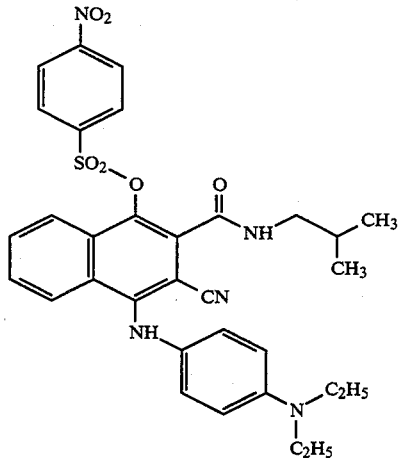 | 190° C. |
| S.02 | 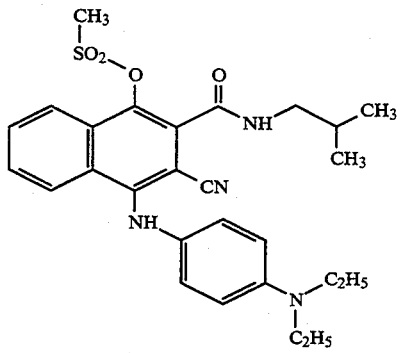 | 167° C. |
| S.03 | 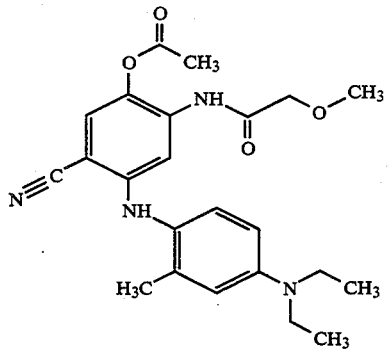 | 137° C. |

TABLE 1-continued
| Dye formula N° | | Structural Melting at |
|---|---|---|
| S.04 | 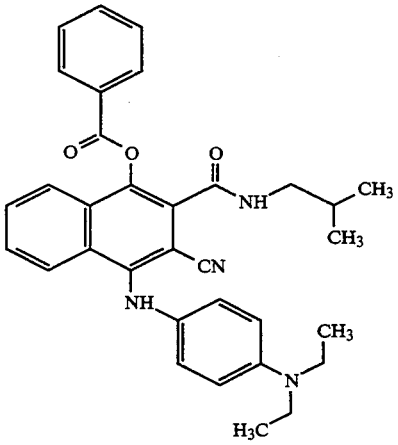 | 220° C. |
| S.05 | 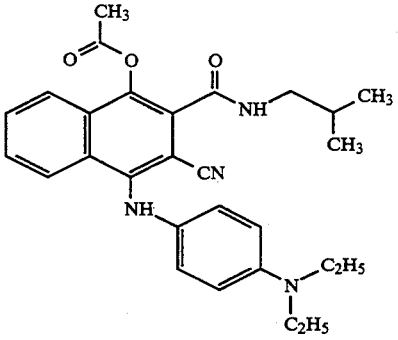 | tacky at 50° C. |
| S.06 | 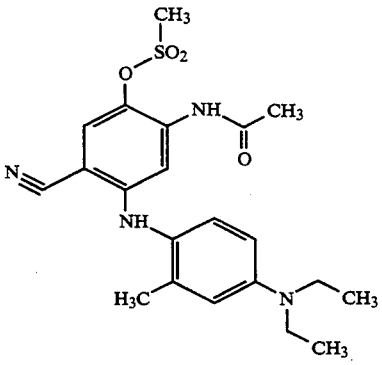 | 193° C. |
| S.07 | 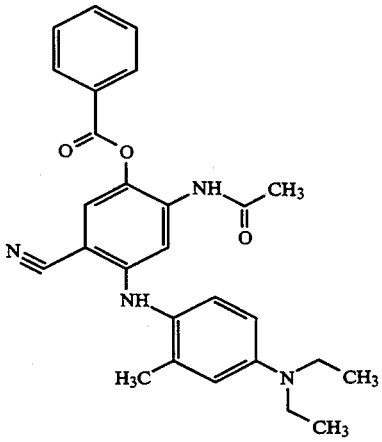 | about 192° C. |
TABLE 1-continued
| Dye formula N° | | Structural Melting at |
|---|---|---|
| S.08 | 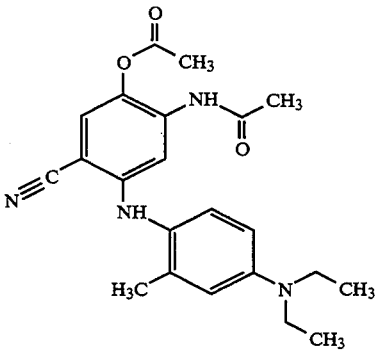 | |
| S.09 | 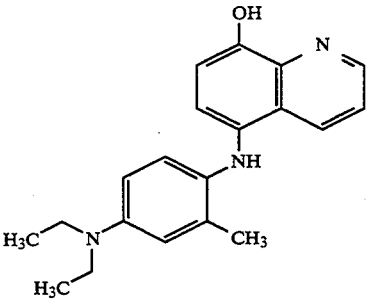 | |
| S.10 | 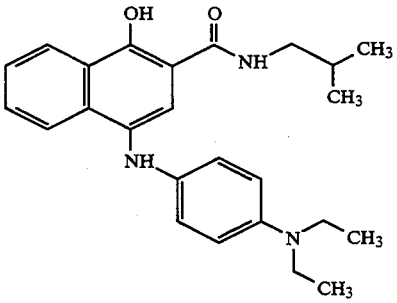 | |
| S.11 | 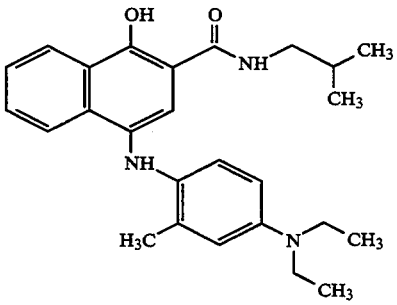 | |

TABLE 1-continued

| Dye formula N° | Structural | Melting at |
|---|---|---|
| S.12 | 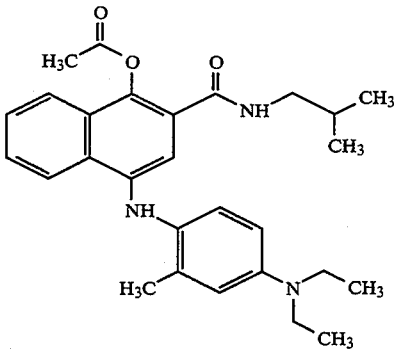 | |
| | 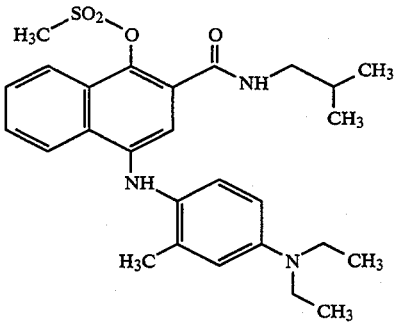 | |
| S.14 | 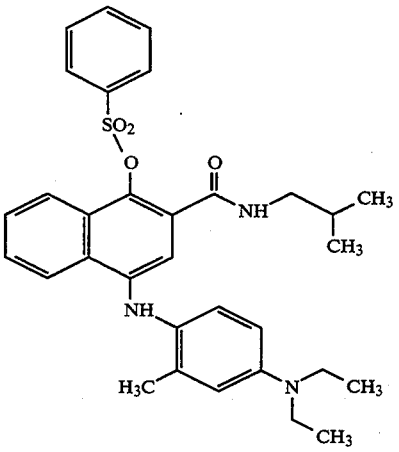 | |

The compounds corresponding to the above general formula can be prepared by reducing the corresponding dye and, if necessary, derivatizing the leuco dye with acyl chlorides. This will become apparent from the preparation examples given hereinafter.

Preparation Example 1

Synthesis of Compound S.05

Compound S.05 is prepared according to the following reaction scheme:

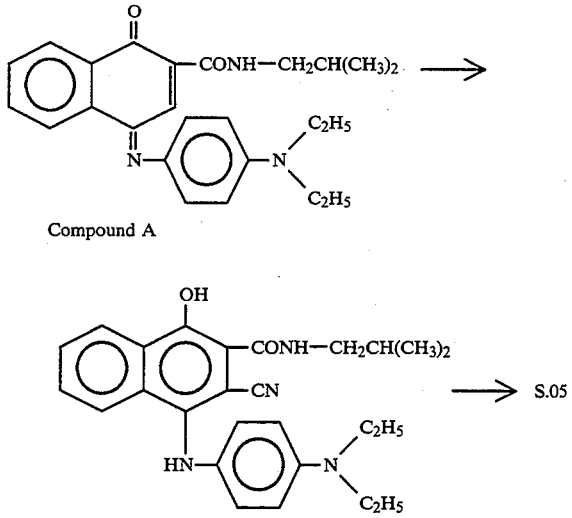

10 g (0.025 mol) of Compound A prepared as described in U.S. Pat. No. 4,987,119 is added under nitrogen atmosphere to a solution of 1.5 g of sodium cyanide and 0.5 ml of water in 50 ml of 1,1,1-trichloroethane. The solution is refluxed for 1 h. 4.2 ml of triethylamine and 2.1 ml of acetyl chloride are added and the hot solution is stirred for 1 h. The solution is washed twice with 0.1N hydrochloric acid, once with a saturated sodium hydrogen carbonate solution, and once with a saturated sodium chloride solution. The solution is dried over sodium sulfate, filtered, concentrated under reduced pressure, and purified by column chromatography.

Yield: 4.7 g of pure Compound S.05

Preparation Example 2

Synthesis of Compound S.11

30 g of Compound A is dissolved in 500 ml of ethyl acetate. 500 ml of water and 37.6 g of sodium hydrosulfite are added thereto with vigorous stirring until discolouration. The water layer is removed and the organic phase is washed with a saturated sodium chloride solution. The product is dried over magnesium sulphate, concentrated under reduced pressure, and purified by column chromatography.

Yield: 5 g of pure Compound S.11

Compound S.09 can be prepared as described in JP 02-238059.

The other compounds listed in Table 1 as well as other compounds not listed in Table 1 but corresponding to the above general formula can be prepared in an analogous way as described in the above preparation examples.

Any dye can be used in the dye layer of the dye-donor element of the present invention provided it is transferable by the action of heat to the receiver sheet and provided it is not altered chemically by the light-stabilizer by said action of heat.

As mentioned before the dye layer can be a monochromic dye layer or it may comprise sequential repeating areas of differently coloured dyes. In case the dye layer is a monochromic dye layer the light-stabilizer may be incorporated therein. In case the dye layer consists of repeating areas of different dyes the light-stabilizer may be incorporated together with the different dyes in said repeating areas. In that case the light-stabilizer is transferred together with dye during the same heating cycle. This brings the advantage that at areas of minimum density (Dmin), i.e. areas to which little or no dye is transferred, also little or no light-stabilizer is transferred and that at areas of maximum density (Dmax), i.e. areas to which high amounts of dye are transferred, also high amounts of light-stabilizer are transferred; in other words there is a direct quantitative relation between transferred dye and transferred light-stabilizer so that an optimal light-stabilization of the transferred dye is guaranteed.

It is, of course, also possible to incorporate the light-stabilizer in separate repeating areas that do not comprise dye. In that case it is transferred during a heating cycle that is different from that causing transfer of dye.

The light-stabilizer can be used in amounts of 10 to 200% by weight, preferably 20 to 150% by weight, calculated on the weight of dye.

The dye layer of the dye-donor element is formed preferably by adding the dyes, the light-stabilizer, a polymeric binder medium, and other optional components to a suitable solvent or solvent mixture, dissolving or dispersing these ingredients to form a coating composition that is applied to a support, which may have been provided first with an adhesive or subbing layer, and dried.

The dye layer thus formed generally has a thickness of about 0.2 to 5.0 μm, preferably 0.4 to 2.0 μm, and the amount ratio of dye to binder generally ranges from 9:1 to 1:3 weight, preferably from 3:1 to 1:2 by weight.

The light-stabilizer can also be present in the dye-donor element in separate repeating areas that do not comprise dye or even in a separate layer on top of the dye layer. Such separate repeating areas or such separate layer may then comprise a polymeric binder and other optional components in addition to the light-stabilizer.

The following polymers can be used as polymeric binder: cellulose derivatives, such as ethyl cellulose, hydroxyethyl cellulose, ethylhydroxy cellulose, ethylhydroxyethyl cellulose, hydroxypropyl cellulose, methyl cellulose, cellulose nitrate, cellulose acetate formate, cellulose acetate hydrogen phthalate, cellulose acetate, cellulose acetate propionate, cellulose acetate butyrate, cellulose acetate pentanoate, cellulose acetate benzoate, cellulose triacetate; vinyl-type resins and derivatives, such as polyvinyl alcohol, polyvinyl acetate, polyvinyl butyral, copolyvinyl butyral-vinyl acetal-vinyl alcohol, polyvinyl pyrrolidone, polyvinyl acetoacetal, polyacrylamide; polymers and copolymers derived from acrylates and acrylate derivatives, such as polyacrylic acid, polymethyl methacrylate and styrene-acrylate copolymers; polyester resins; polycarbonates; copolystyrene-acrylonitrile; polysulfones; polyphenylene oxide; organosilicones, such as polysiloxanes; epoxy resins and natural resins, such as gum arabic. Preferably, the binder for the dye layer of the present invention comprises cellulose acetate butyrate or copolystyrene-acrylonitrile.

The dye-donor element of the present invention can be used for the recording of a coloured image together with primary colour dye-donor elements comprising a magenta dye or a mixture of magenta dyes, a cyan dye or a mixture of cyan dyes, and a yellow dye or a mixture of yellow dyes respectively.

The light-stabilizers can be used alone or mixed with one another, or even mixed with other primary colour dyes.

Typical and specific examples of other primary colour dyes for use in thermal dye sublimation transfer have been described in e.g. EP 400,706, EP 209,990, EP 216,483, EP 218,397, EP 227,095, EP 227,096, EP 229,374, EP 235,939, EP 247,737, EP 257,577, EP 257,580, EP 258,856, EP 279,330, EP 279,467, EP 285,665, U.S. Pat. No. 4,743,582, U.S. Pat. No. 4,753,922, U.S. Pat. No. 4,753,923, U.S. Pat. No. 4,757,046, U.S. Pat. No. 4,769,360, U.S. Pat. No. 4,771,035, JP 84/78,894, JP 84/78,895, JP 84/78,896, JP 84/227,490, JP 84/227,948, JP 85/27,594, JP 85/30,391, JP 85/229,787, JP 85/229,789, JP 85/229,790, JP 85/229,791, JP 85/229,792, JP 85/229,793, JP 85/229,795, JP 86/268,493, JP 86/268,494, JP 85/268,495, and JP 86/284,489.

The dye layer and/or the layer comprising the light-stabilizer may also contain other additives, such as curing agents, preservatives, organic or inorganic fine particles, dispersing agents, antistatic agents, defoaming agents, viscosity-controlling agents, these and other ingredients having been described more fully in EP 133,011, EP 133,012, EP 111,004, and EP 279,467.

Any material can be used as the support for the dye-donor element provided it is dimensionally stable and capable of withstanding the temperatures involved, up to 400° C. over a period of up to 20 msec, and is yet thin enough to transmit heat applied on one side through to the dye on the other side to effect transfer to the receiver sheet within such short periods, typically from 1 to 10 msec. Such materials include polyesters such as polyethylene terephthalate, polyamides, polyacrylates, polycarbonates, cellulose esters, fluorinated polymers, polyethers, polyacetals, polyolefins, polyimides, glassine paper and condenser paper. Preference is given to a support comprising polyethylene terephthalate. In general, the support has a thickness of 2 to 30 μm. The support may also be coated with an adhesive of subbing layer, if desired.

The dye layer and/or the layer comprising the light-stabilizer can be coated or printed by a printing technique such as a gravure process.

A dye-barrier layer comprising a hydrophilic polymer may be provided between the support and the dye layer of the dye-donor element to enhance the dye transfer densities by preventing wrongway transfer of dye backwards to the support. The dye barrier layer may contain any hydrophilic material that is useful for the intended purpose. In general, good results have been obtained with gelatin, polyacrylamide, polyisopropyl acrylamide, butyl methacrylate-grafted gelatin, ethyl methacrylate-grafted gelatin, ethyl acrylate-grafted gelatin, cellulose monoacetate, methylcellulose, polyvinyl alcohol, polyethyleneimine, polyacrylic acid, a mixture of polyvinyl alcohol and polyvinyl acetate, a mixture of polyvinyl alcohol and polyacrylic acid, or a mixture of cellulose monoacetate and polyacrylic acid. Suitable dye barrier layers have been described in e.g. EP 227,091 and EP 228,065. Certain hydrophilic polymers e.g. those described in EP 227,091 also have an adequate adhesion to the support and the dye layer, so that the need for a separate adhesive or subbing layer is avoided. These particular hydrophilic polymers used in a single layer in the dye-donor element thus perform a dual function, hence are referred to as dye-barrier/subbing layers.

Preferably the reverse side of the dye-donor element has been coated with a slipping layer to prevent the printing head from sticking to the dye-donor element.

Such a slipping layer would comprise a lubricating material such as a surface-active agent, a liquid lubricant, a solid lubricant or mixtures thereof, with or without a polymeric binder. The surface-active agents may be any agents known in the art such as carboxylates, sulfonates, phosphates, aliphatic amine salts, aliphatic quaternary ammonium salts, polyoxyethylene alkyl ethers, polyethylene glycol fatty acid esters, fluoroalkyl $C_2$–$C_{20}$ aliphatic acids. Examples of liquid lubricants include silicone oils, synthetic oils, saturated hydrocarbons, and glycols. Examples of solid lubricants include various higher alcohols such as stearyl alcohol, fatty acids and fatty acid exters. Suitable slipping layers have been described in e.g. EP 138,483, EP 227,090, U.S. Pat. No. 4,567,113, U.S. Pat. No. 4,572,860, U.S. Pat. No. 4,717,711. Preferably the slipping layer comprises copolystyrene-acrylonitrile or a styrene-acrylonitrile-butadiene copolymer or a mixture thereof or a polycarbonate as described in European patent application no. 91202071.6, as binder and a polysiloxane-polyether copolymer or polytetrafluoroethylene or a mixture thereof as lubicrant in an amount of 0.1 to 10% by weight of the binder or binder mixture.

The receiver sheet for receiving an image-wise distribution of dye by thermal dye sublimation transfer from a dye-donor element may also comprise a said light-stabilizer corresponding to the general formula in claim 1.

The support for the receiver sheet that is used with the dye-donor element may be a transparent film of e.g. polyethylene terephthalate, a polyether sulfone, a polyimide, a cellulose ester or a polyvinyl alcohol-co-acetal. The support may also be a reflective one such as a baryta-coated paper, polyethylene-coated paper or white polyester i.e. white-pigmented polyester. Blue-coloured polyethylene terephthalate film can also be used as support.

To avoid poor adsorption of the transferred dye to the support of the receiver sheet this support can be coated with a special layer called dye-image-receiving layer, into which the dye can diffuse more readily. The dye-image-receiving layer may comprise e.g. a polycarbonate, a polyurethane, a polyester, a polyamide, polyvinyl chloride, copolystyrene-acrylonitrile, polycaprolactone, or mixtures thereof as binder. The dye-image receiving layer may also comprise a heat-cured product of poly(vinyl chloride/co-vinyl acetate/co-vinyl alcohol) and polyisocyanate. Suitable dye-image-receiving layers have been described in e.g. EP 133,011, EP 133,012, EP 144,247, EP 227,094, and EP 228,066.

The light-stabilizer corresponding to the above general formula may be present in a dye-image-receiving layer comprising a binder. In that case the dye-donor element need not comprise the light-stabilizer.

The light-stabilizer corresponding to the above general formula can be present in the dye-image-receiving layer in an amount of 10 to 100% by weight calculated on the weight of binder present in said dye-image-receiving layer.

In order to further improve the light-fastness and other stabilities of recorded images singlet oxygen quenchers such as HALS-compounds (Hindered Amine Light-stabilizers) and/or antioxidants can be incorporated into the dye-image-receiving layer.

The dye layer of the dye-donor element or the dye-image-receiving layer of the receiver sheet may also contain a releasing agent that aids in separating the dye-donor element from the receiver sheet after transfer. The releasing agents can also be incorporated in a separate layer on at least part of the dye layer and/or of the dye-image-receiving layer. Suitable releasing agents are solid waxes, fluorine- or phosphate-containing surface-active agents and silicone oils. Suitable releasing agents have been described in e.g. EP 133,012, JP 85/19,138, and EP 227,092.

The dye-donor elements according to the invention are used to form a dye transfer image, which process comprises placing the dye layer of the dye-donor element in face-to-face relation with the dye-image-receiving layer of the receiver sheet and image-wise heating from the back of the dye-donor element. The transfer of the dye is accomplished by heating for about several milliseconds at a temperature of 400° C.

When the process is performed for but one single colour, a monochromic dye transfer image is obtained. A multicolour image can be obtained by using a dye-donor element containing three or more primary colour dyes and sequentially performing the process steps described above for each colour. The above sandwich of dye-donor element and receiver sheet is formed on three occasions during the time when heat is applied by the thermal printing head. After the first dye has been transferred, the elements are peeled apart. A second dye-donor element (or another area of the dye-donor element with a different dye area) is then brought in register with the dye-receiving element and the process is repeated. The third colour and optionally further colours are obtained in the same manner.

In addition to thermal heads, laser light, infrared flash, or heated pens can be used as the heat source for supplying heat energy. Thermal printing heads that can be used to transfer dye from the dye-donor elements of the present invention to a receiver sheet are commercially available. In case laser light is used, the dye layer or another layer of the dye element has to contain a compound that absorbs the light emitted by the laser and converts it into heat e.g. carbon black.

Alternatively, the support of the dye-donor element may be an electrically resistive ribbon consisting of e.g. a multilayer structure of a carbon-loaded polycarbonate coated with a thin aluminium film. Current is injected into the resistive ribbon by electrically addressing a printing head electrode resulting in highly localized heating of the ribbon beneath the relevant electrode. The fact that in this case the heat is generated directly in the resistive ribbon and that it is thus the ribbon that gets hot leads to an inherent advantage in printing speed using the resistive ribbon/electrode head technology as compared to the thermal head technology, according to which the various elements of the thermal head get hot and must cool down before the head can move to the next printing position.

The following examples illustrate the invention in more detail without, however, limiting the scope thereof.

EXAMPLE 1

Receiver sheets were prepared by coating a polyethylene terephthalate film support having a thickness of 175 μm with a dye-image-receiving layer from a solution in ethyl methyl ketone of 3,6 g/m$^2$ of poly(vinyl chloride/co-vinyl acetate/co-vinyl alcohol) (Vinylite VAGD supplied by Union Carbide), 0,336 g/m$^2$ of diisocyanate (Desmodur VL supplied by Bayer AG), and 0,2 g/m$^2$ of hydroxy-modified polydimethylsiloxane (Tegomer H SI 2111 supplied by Goldschmidt).

Dye-donor elements for use according to thermal dye sublimation transfer were prepared as follows:

A solution comprising an amount of light-stabilizer as indicated in the following Table 2, 0.5% by weight of dye as indicated in Table 2, and 0.5% by weight of copolystyrene-acrylonitrile (Luran 388S, supplied by BASF, Germany) as binder in ethyl methyl ketone was prepared.

From this solution a dye layer having a wet thickness of 100 μm was coated on a polyethylene terephthalate film support having a thickness of 6 μm and carrying a conventional subbing layer. The resulting dye layer was dried by evaporation of the solvent.

The opposite side of the film support was coated with a subbing layer of a copolyester comprising ethylene glycol, adipic acid, neopentyl glycol, terephthalic acid, isophthalic acid, and glycerol.

The resulting subbing layer was covered with a solution in methyl ethyl ketone of 0.5 g/m$^2$ of a polycarbonate having the following structural formula to form a heat-resistant layer:

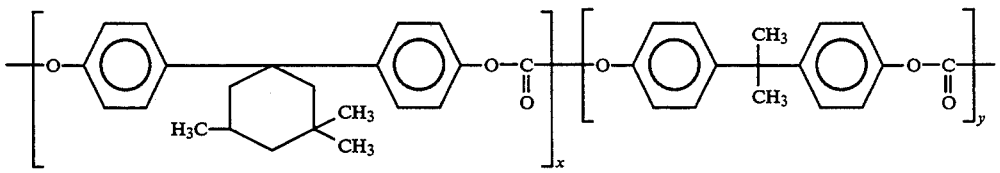

wherein x=55 mol % and y =45 mol %.

Finally, a top layer of polyether-modified polydimethylsiloxane (Tegoglide 410, Goldschmidt) was coated from a solution in isopropanol on the resulting heat-resistant polycarbonate layer.

The dye-donor element was printed in combination with a receiver sheet in a Mitsubishi colour video printer CP100E.

The receiver sheet was separated from the dye-donor element and the colour density value of the recorded image was measured by means of a Macbeth TR 924 densitometer in the red, green, and blue region in Status A mode.

The above described experiment was repeated for the dyes and light-stabilizers indicated in Table 2 hereinafter.

Finally, each receiver sheet was subjected to irradiation by means of a xenon lamp of 150 klux for a time indicated in hours in Table 2 and the colour density values were measured again. The density change was calculated and is listed in percent in Table 2.

The chemical structure of the dyes used in the experiments is given in Table 3 hereinafter.

| Dye | Light-stabilizer | | Density change in % after xenon exposure for | |
|---|---|---|---|---|
| N° | N° | % by weight used | 4 h | 12 h |
| D01 | none | | −36 | −73 |
| D01 | S.03 | 0.5 | −5 | −16 |
| D01 | S.03 | 0.2 | −10 | −39 |
| D01 | S.02 | 0.5 | −16 | −38 |
| D01 | S.02 | 0.2 | −27 | −67 |
| D01 | S.01 | 0.5 | −30 | −63 |
| D01 | S.04 | 0.5 | −13 | |
| D01 | S.05 | 0.5 | −6 | |
| D01 | S.06 | 0.5 | −8 | −44 |
| D01 | S.06 | 0.2 | −4 | −35 |
| D01 | S.07 | 0.2 | −1 | −14 |
| D01 | S.07 | 0.5 | +4 | −2 |

-continued

| Dye | Light-stabilizer | | Density change in % after xenon exposure for | |
|---|---|---|---|---|
| N° | N° | % by weight used | 4 h | 12 h |
| D01 | S.09 | 0.2 | +3 | −7 |
| D01 | S.10 | 0.2 | −8 | −47 |
| D01 | S.10 | 0.5 | −14 | −54 |
| D02 | none | | −65 | −93 |
| D02 | S.08 | 0.2 | −33 | −79 |
| D02 | S.08 | 0.5 | −22 | −64 |
| D02 | S.09 | 0.2 | −22 | −63 |
| D02 | S.09 | 0.5 | −12 | −38 |
| D02 | S.10 | 0.2 | −38 | −84 |
| D02 | S.10 | 0.5 | −26 | −75 |
| D03 | none | | −80 | −95 |
| D03 | S.08 | 0.2 | −60 | −92 |
| D03 | S.08 | 0.5 | −18 | −62 |
| D04 | none | | −30 | −63 |
| D04 | S.08 | 0.2 | −13 | −64 |
| D04 | S.08 | 0.5 | 0 | −34 |
| D04 | S.03 | 0.5 | −22 | |
| D04 | S.06 | 0.2 | −13 | −61 |
| D04 | S.06 | 0.5 | −6 | −52 |
| D04 | S.09 | 0.2 | +5 | −10 |
| D04 | S.10 | 0.2 | −13 | −55 |
| D04 | S.10 | 0.5 | −9 | −48 |
| D05 | none | | −35 | −73 |
| D05 | S.08 | 0.2 | −16 | −60 |
| D05 | S.08 | 0.5 | −11 | −29 |
| D05 | S.09 | 0.2 | −8 | −17 |
| D05 | S.09 | 0.5 | −8 | −12 |
| D05 | S.10 | 0.2 | −25 | −67 |
| D05 | S.10 | 0.5 | −14 | −41 |
| D06 | none | | −54 | −79 |
| D06 | S.03 | 0.2 | −40 | −81 |
| D06 | S.03 | 0.5 | −11 | −80 |
| D06 | S.06 | 0.2 | −27 | −72 |
| D06 | S.06 | 0.5 | −12 | −62 |
| D06 | S.07 | 0.2 | −11 | −66 |
| D06 | S.07 | 0.5 | −10 | −27 |
| D06 | S.05 | 0.5 | −12 | −72 |
| D06 | S.09 | 0.2 | 0 | −32 |
| D06 | S.09 | 0.5 | +2 | −6 |
| D06 | S.10 | 0.2 | −15 | −69 |
| D06 | S.10 | 0.5 | −6 | −49 |
| D07 | none | | −88 | −95 |
| D07 | S.07 | 0.2 | −74 | −93 |
| D07 | S.07 | 0.5 | −58 | −86 |
| D07 | S.09 | 0.2 | −33 | −72 |
| D07 | S.09 | 0.5 | −15 | −32 |

TABLE 3 dyes of different structural classes

D.01

D.02

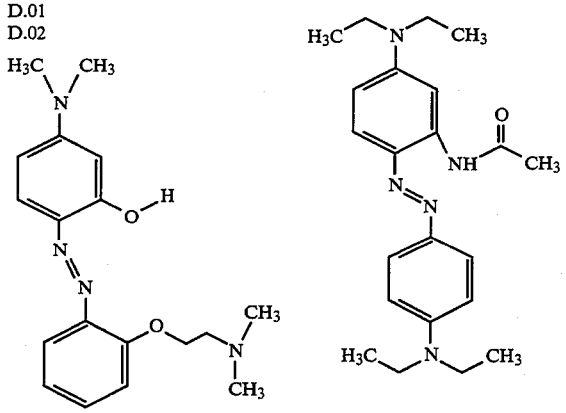

D.03

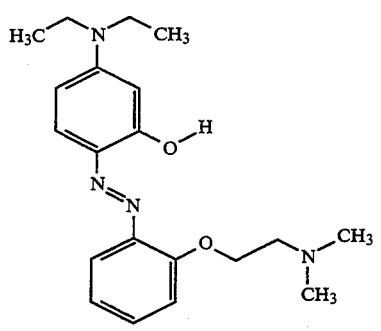

D.04

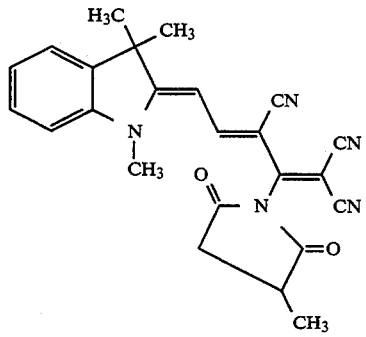

D.05

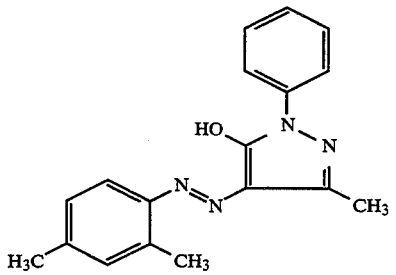

D.06

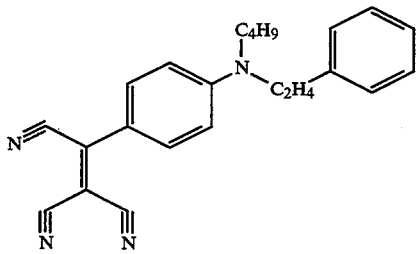

TABLE 3-continued dyes of different structural classes

D.07

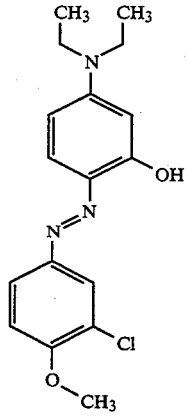

D.08

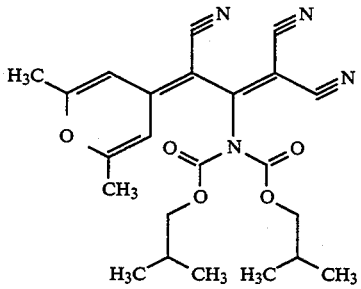

D.09

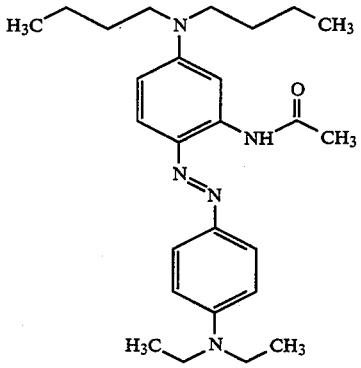

The results listed in Table 2 show that the light-stabilizers used according to the present invention are capable of making a wide range of dyes belonging to various structural classes more stable to light.

EXAMPLE 2

Dye-donor elements were prepared as described in Example 1, with the proviso that dyes, light-stabilizers according to the present invention, a prior art light-stabilizer described in EP 312,812 (taken for comparison purposes), and amounts, all as indicated in Table 4 hereinafter, were used.

The prior art light-stabilizer COMP. corresponds to the following structural formula:

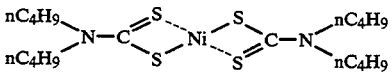

COMP.

Commercially available elements supplied by Mitsubishi, Type CK 100 S were used as receiver sheets for tests 1 to 14. Receiver sheets as described in Example 1 hereinbefore were used for tests 15 to 17.

All tests and measurements were carried out as described in the above Example 1.

The results of the tests are listed in Table 4 hereinafter.

TABLE 4

| Test N° | Dye N° | Light-stabilizer N° | Light-stabilizer % by wt. used | Density change in % after xenon exposure for 4 h | Density change in % after xenon exposure for 12 h |
|---|---|---|---|---|---|
| 1 | D01 | | none | −2 | −47 |
| 2 | D01 | S.08 | 0.2 | −3 | −21 |
| 3 | D01 | COMP. | 0.2 | −1 | −17 |
| 4 | D01 | S.08 | 0.5 | 0 | −8 |
| 5 | D01 | COMP. | 0.5 | 0 | −9 |
| 6 | D02 | | none | −9 | −69 |
| 7 | D02 | S.08 | 0.2 | −2 | −40 |
| 8 | D02 | COMP. | 0.2 | −3 | −31 |
| 9 | D02 | S.08 | 0.5 | +3 | −18 |
| 10 | D02 | COMP. | 0.5 | −5 | −19 |
| 11 | D08 | | none | −3 | −5 |
| 12 | D08 | COMP. | 0.1 | −6 | −15 |
| 13 | D08 | COMP. | 0.25 | −11 | −27 |
| 14 | D08 | COMP. | 0.5 | −19 | −36 |
| 15 | D08 | | none | −5 | −23 |
| 16 | D08 | S.07 | 0.2 | −33 | −52 |
| 17 | D08 | S.07 | 0.5 | −47 | −66 |

The results of tests 1 to 10 show that the light-stabilizers according to the present invention perform as good as prior art light-stabilizers. However, the light-stabilizers of the present invention have the supplemental advantage of being free of heavy metal ions, which means that they are far more acceptable from an ecological standpoint than most prior art light-stabilizers. Moreover, thanks to the fact that both the dye and the light-stabilizer had been incorporated in the dye layer as described in Examples 1 and 2, a direct quantitative relation is created between transferred dye and transferred light-stabilizer so that an optimal light-stabilization of the transferred dye is guaranteed.

We claim:

1. Dye-donor element for use according to thermal dye sublimation transfer, said dye-donor element comprising a support having thereon a dye layer comprising at least one dye and a binder, wherein said dye layer or a top layer thereon also comprises a light-stabilizer for said at least one dye, said light-stabilizer being a leuco-indoaniline dye.

2. Dye-donor element according to claim 1 wherein said leuco-indoaniline dye corresponds to the following general formula:

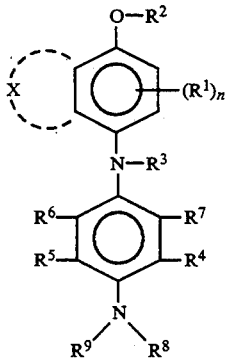

wherein:

$R^1$ represents hydrogen or any substituent, n is 0, 1 or 2, each of $R^2$ and $R^3$ independently represents hydrogen or an acyl group chosen from the group of $—COR^{10}$, $—SO_2R^{10}$, and $—OPR^{10}R^{11}$, X is zero or represents the atoms needed to complete an aromatic, alicyclic, or heterocyclic ring or ring system, or a such ring or ring system in substituted form, each of $R^4$, $R^5$, $R^6$ and $R^7$ independently represents hydrogen, an alkyl group, a substituted alkyl group, a cycloalkyl group, a substituted cycloalkyl group, an aryl group, a substituted aryl group, an alkyloxy group, a substituted alkyloxy group, an aryloxy group, a substituted aryloxy group, a carbamoyl group, a substituted carbamoyl group, a sulphamoyl group, a substituted sulphamoyl group, hydroxy, a halogen atom, $—NH—SO_2R^{12}$, $—NH—COR^{12}$, $—O—SO_2R^{12}$, or $—O—COR^{12}$, or $R^4$ and $R^7$ together and $R^5$ and $R^6$ together represent the atoms necessary to complete an aliphatic ring, a substituted aliphatic ring, a heterocyclic nucleus, a substituted heterocyclic nucleus, a heterocyclic nucleus carrying a fused-on cycloaliphatic, aromatic, or heterocyclic ring or ring system, or a substituted heterocyclic nucleus carrying a fused-on cycloaliphatic, aromatic, or heterocyclic ring or ring system, or $R^4$ and $R^8$ and/or $R^5$ and $R^9$ together and $R^5$ and $R^6$ together represent the atoms necessary to complete to complete a heterocyclic nucleus or a substituted heterocyclic nucleus, each of $R^8$ and $R^9$ independently represents hydrogen, an alkyl group, a substituted alkyl group, a cycloalkyl group, a substituted cycloalkyl group, an aryl group, a substituted aryl group, a heterocyclic nucleus, a substituted heterocyclic nucleus, or $R^8$ and $R^9$ together represent the atoms necessary to complete to complete a heterocyclic nucleus or a substituted heterocyclic nucleus, each of $R^{10}$, $R^{11}$, and $R^{12}$ independently represents an alkyl group, a substituted alkyl group, a cycloalkyl group, a substituted cycloalkyl group, an alkenyl group, a substituted alkenyl group, an aryl group, a substituted aryl group, an alkyloxy group, a substituted alkyloxy group, an aryloxy group, a substituted aryloxy group, an alkylthio group, a substituted alkylthio group, an arylthio, a substituted arylthio group, an amino group, a substituted amino group, a heterocyclic nucleus, or a substituted heterocyclic nucleus.

3. A dye-donor element according to claim 1 or 2, wherein said light-stabilizer is used in amounts of 20 to 150% by weight calculated on the weight of said dye.

4. Dyed receiver sheet comprising a substrate, a dye-receiving layer, at least one dye and at least one light-stabilizer for said dye, wherein said dye and said light-stabilizer are present in an image-wise distribution produced by thermal dye sublimation transfer from a dye-donor element and said light-stabilizer is a leuco-indoaniline dye.

5. Dyed receiver sheet according to claim 4, wherein said leuco-indoaniline dye corresponds to the following general formula:

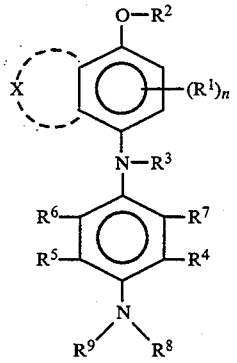

wherein:

$R^1$ represents hydrogen or any substituent, n is 0, 1 or 2, each of $R^2$ and $R^3$ independently represents hydrogen or an acyl group chosen from the group of $—COR^{10}$, $—SO_2R^{10}$, $—OPR^{10}R^{11}$, X is zero or represents the atoms needed to complete an aromatic, alicyclic, or heterocyclic ring or ring system, or a such ring or ring system in substituted form, each of $R^4$, $R^5$, $R^6$, and $R^7$ independently represents hydrogen, an alkyl group, a substituted alkyl group, a cycloalkyl group, a substituted cycloalkyl group, an aryl group, a substituted aryl group, an alkyloxy group, a substituted alkyloxy group, an aryloxy group, a substituted aryloxy group, a carbamoyl group, a substituted carbamoyl group, a sulphamoyl group, a substituted sulphamoyl group, hydroxy, a halogen atom, $—NH—SO_2R^{12}$, $—NH—COR^{12}$, $—O—SO_2R^{12}$, or $—O—COR^{12}$, or $R^4$ and $R^7$ together and $R^5$ and $R^6$ together represent the atoms necessary to complete an aliphatic ring, a substituted aliphatic ring, a heterocyclic nucleus, a substituted heterocyclic nucleus, a heterocyclic nucleus carrying a fused-on cycloaliphatic, aromatic, or heterocyclic ring or ring system, or a substituted heterocyclic nucleus carrying a fused-on cycloaliphatic, aromatic, or heterocyclic ring or ring system, or $R^4$ and $R^8$ and/or $R^5$ and $R^9$ together and $R^5$ and $R^6$ together represent the atoms necessary to complete to complete a heterocyclic nucleus or a substituted heterocyclic nucleus, each of $R^8$ and $R^9$ independently represents hydrogen, an alkyl group, a substituted alkyl group, a cycloalkyl group, a substituted cycloalkyl group, an aryl group, a substituted aryl group, a heterocyclic nucleus, a substituted heterocyclic nucleus, or $R^8$ and $R^9$ together represent the atoms necessary to complete to complete a heterocyclic nucleus or a substituted heterocyclic nucleus, each of $R^{10}$, $R^{11}$, and $R^{12}$ independently represents an alkyl group, a substituted alkyl group, a cycloalkyl group, a substituted cycloalkyl group, an alkenyl group, a substituted alkenyl group, an aryl group, a substituted aryl group, an alkyloxy group, a substituted alkyloxy group, an aryloxy group, a substituted aryloxy group, an alkylthio group, a substituted alkylthio group, an arylthio, a substituted arylthio group, an amino group, a substituted amino group, a heterocyclic nucleus, or a substituted heterocyclic nucleus.

6. Receiver sheet for receiving an image-wise distribution of dye by thermal dye sublimation transfer from a dye-donor element, wherein said receiver sheet comprises a substrate, a dye-receiving layer and a light-stabilizer for said dye, said light-stabilizer being a leuco-indoaniline dye.

7. Receiver sheet according to claim 6, wherein said leuco indoaniline dye corresponds to the following general formula:

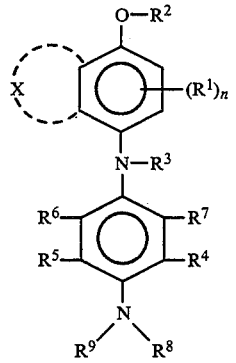

wherein:

$R^1$ represents hydrogen or any substituent, n is 0, 1 or 2, each of $R^2$ and $R^3$ independently represents hydrogen or an acyl group chosen from the group of $—COR^{10}$, $—SO_2R^{10}$, and $—OPR^{10}R^{11}$, X is zero or represents the atoms needed to complete an aromatic, alicyclic, or heterocyclic ring or ring system, or a such ring or ring system in substituted form, each of $R^4$, $R^5$, $R^6$, and $R^7$ independently represents hydrogen, an alkyl group, a substituted alkyl group, a cycloalkyl group, a substituted cycloalkyl group, an aryl group, a substituted aryl group, an alkyloxy group, a substituted alkyloxy group, an aryloxy group, a substituted aryloxy group, a carbamoyl group, a substituted carbamoyl group, a sulphamoyl group, a substituted sulphamoyl group, hydroxy a halogen atom, $—NH—SO_2R^{12}$, $—NH—COR^{12}$, $—O—SO_2R^{12}$, or $—O—COR^{12}$, or $R^4$ and $R^7$ together and $R^5$ and $R^6$ together represent the atoms necessary to complete an aliphatic ring, a substituted aliphatic ring, a heterocyclic nucleus, a substituted heterocyclic nucleus, a heterocyclic nucleus carrying a fused-on cycloaliphatic, aromatic, or heterocyclic ring or ring system, or a substituted heterocyclic nucleus carrying a fused-on cycloaliphatic, aromatic, or heterocyclic ring or ring system, or $R^4$ and $R^8$ and/or $R^5$ and $R^9$ together and $R^5$ and $R^6$ together represent the atoms necessary to complete to complete a heterocyclic nucleus or a substituted heterocyclic nucleus, each of $R^8$ and $R^9$ independently represents hydrogen, an alkyl group, a substituted alkyl group, a cycloalkyl group, a substituted cycloalkyl group, an aryl group, a substituted aryl group, a heterocyclic nucleus, a substituted heterocyclic nucleus, or $R^8$ and $R^9$ together represent the atoms necessary to complete to complete a heterocyclic nucleus or a substituted heterocyclic nucleus, each of $R^{10}$, $R^{11}$, and $R^{12}$ independently represents an alkyl group, a substituted alkyl group, a cycloalkyl group, a substituted cycloalkyl group, an alkenyl group, a substituted alkenyl group, an aryl group, a substituted aryl group, an alkyloxy group, a substituted alkyloxy group, an aryloxy group, a substituted aryloxy group, an alkylthio group, a substituted alkylthio group, an arylthio, a substituted arylthio group, an amino group, a substituted amino group, a heterocyclic nucleus, or a substituted heterocyclic nucleus.

8. Receiver sheet according to claim 6, wherein said light-stabilizer is present in a dye-image-receiving layer comprising a binder.

9. Receiver sheet according to claim 8, wherein said light-stabilizer is present in an amount of 10 to 100% by weight calculated on the weight of said binder.

10. Method of forming a light-fast dye image by image-wise heating a dye-donor element comprising a dye layer comprising a binder and at least one dye, and in said dye layer or in a layer on top of said dye layer a light-stabilizer for said dye, said light-stabilizer being a leuco-indoaniline dye, and causing transfer of the image-wise heated dye and light-stabilizer to a receiver sheet.

11. Method of forming a light-fast dye image by image-wise heating a dye-donor element comprising a dye layer comprising a binder and at least one dye, and causing transfer of the image-wise heated dye to a receiver sheet, wherein said receiver sheet comprises a light-stabilizer for the transferred dye, said light-stabilizer being a leuco-indoaniline dye.

* * * * *

UNITED STATES PATENT AND TRADEMARK OFFICE

CERTIFICATE OF CORRECTION

PATENT NO. : 5,426,088

DATED : June 20, 1995

INVENTOR(S) : Janssens et al.

It is certified that error appears in the above-indentified patent and that said Letters Patent is hereby corrected as shown below:

On the title page: Item 56, "4,270,480" should read --4,720,480--;

Title page, 2nd Column, 2nd line, "0-4" should read --0-4,--;

Column 7, line 23, insert at lefthand margin --S.13--;

Column 13, line 55, insert the heading --Table 2--.

Signed and Sealed this

Thirtieth Day of January, 1996

Bruce Lehman

*Attest:*

BRUCE LEHMAN

*Attesting Officer*

*Commissioner of Patents and Trademarks*